US011308867B2

(12) United States Patent
Wei

(10) Patent No.: US 11,308,867 B2
(45) Date of Patent: Apr. 19, 2022

(54) IMAGE PROCESSING METHOD, IMAGE PROCESSING DEVICE, DISPLAY DEVICE AND STORAGE MEDIUM

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventor: Xiaolong Wei, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/623,703

(22) PCT Filed: Mar. 28, 2019

(86) PCT No.: PCT/CN2019/080153
§ 371 (c)(1),
(2) Date: Dec. 17, 2019

(87) PCT Pub. No.: WO2019/196667
PCT Pub. Date: Oct. 17, 2019

(65) Prior Publication Data

US 2020/0143737 A1 May 7, 2020

(30) Foreign Application Priority Data

Apr. 10, 2018 (CN) ..... 201810317032.2

(51) Int. Cl.
*G09G 3/3208* (2016.01)

(52) U.S. Cl.
CPC ... *G09G 3/3208* (2013.01); *G09G 2320/0257* (2013.01); *G09G 2320/0261* (2013.01)

(58) Field of Classification Search
CPC ..... G09G 3/007; G09G 2320/0257; G09G 2320/046; G09G 2320/103; G09G 2320/043
See application file for complete search history.

(56) References Cited

U.S. PATENT DOCUMENTS 7,983,510 B2 * 7/2011 Hsieh ..... H04N 5/144 382/275
2003/0090488 A1 5/2003 Yoo
(Continued)

FOREIGN PATENT DOCUMENTS

CN 1641727 A 7/2005
CN 102479534 A 5/2012
(Continued)

OTHER PUBLICATIONS

First Chinese Office Action Application No. 201810317032.2; dated Jan. 28, 2021.
(Continued)

*Primary Examiner* — Yuzhen Shen

(57) ABSTRACT

A method for processing a display image in an image display region, a display image processing device, a display device, and a storage medium are disclosed. A part of the image display region or all of the image display region is a movable region, and the method for processing the display image includes: in a case where the movable region is moved from a first position to a second position, obtaining a first image feature value of the display image displayed in the image display region where the movable region is at the first position; obtaining a second image feature value of the display image displayed in the image display region where the movable region is at the second position; and determin-
(Continued)

ing whether the display image displayed in the image display region is a static image based on the first image feature value and the second image feature value.

11 Claims, 9 Drawing Sheets

(56) References Cited

U.S. PATENT DOCUMENTS

| | | | | |
|---|---|---|---|---|
| 2009/0245571 | A1 | 10/2009 | Chien et al. | |
| 2009/0295768 | A1* | 12/2009 | Shin | G09G 3/3648 345/204 |
| 2011/0227961 | A1* | 9/2011 | Kikuta | G09G 3/007 345/690 |
| 2012/0320107 | A1* | 12/2012 | Murakami | G09G 3/3611 345/690 |
| 2016/0321973 | A1* | 11/2016 | Chun | G09G 3/2092 |
| 2017/0221455 | A1 | 8/2017 | Lee et al. | |
| 2018/0204509 | A1* | 7/2018 | Lu | H01L 51/56 |
| 2018/0357955 | A1 | 12/2018 | Wang et al. | |

FOREIGN PATENT DOCUMENTS

| | | | |
|---|---|---|---|
| CN | 107016961 | A | 8/2017 |
| JP | 2007304318 | A | 11/2007 |

OTHER PUBLICATIONS

The extended European search report dated Nov. 24, 2021; Appln. No. 19786093.5.

* cited by examiner

IMAGE PROCESSING METHOD, IMAGE PROCESSING DEVICE, DISPLAY DEVICE AND STORAGE MEDIUM

The application claims priority to Chinese patent application No. 201810317032.2, filed on Apr. 10, 2018, the entire disclosure of which is incorporated herein by reference as part of the present application.

TECHNICAL FIELD

Embodiments of the present disclosure relate to a method for processing a display image displayed in an image display region, a display image processing device, a display device, and a storage medium.

BACKGROUND

An organic light-emitting diode (OLED) display is an all-solid-state and active-light-emitting display. The OLED display has characteristics such as high brightness, high contrast, ultra-thin and ultra-light, low power consumption, no limitation of viewing angles, a wide operating temperature range, etc., and therefore is considered to be emerging next-generation display.

SUMMARY

At least an embodiment of the present disclosure provides a method for processing a display image in an image display region. A part of the image display region or all of the image display region is a movable region, and the method for processing the display image includes: in a case where the movable region is moved from a first position to a second position, obtaining a first image feature value of the display image displayed in the image display region where the movable region is at the first position; obtaining a second image feature value of the display image displayed in the image display region where the movable region is at the second position; and determining whether the display image displayed in the image display region is a static image based on the first image feature value and the second image feature value.

For example, in the method for processing the display image provided by an embodiment of the present disclosure, the determining whether the display image displayed in the image display region is a static image based on the first image feature value and the second image feature value, includes: determining whether the first image feature value and the second image feature value are equal; and determining the display image displayed in the image display region as a static image in a case where the first image feature value and the second image feature value are equal.

For example, the method for processing the display image provided by an embodiment of the present disclosure further includes setting a threshold parameter. The determining whether the display image displayed in the image display region is a static image based on the first image feature value and the second image feature value, includes: calculating an absolute value of a difference between the first image feature value and the second image feature value; determining the display image displayed in the image display region as a non-static image in a case where the absolute value of the difference is greater than the threshold parameter; and determining the display image displayed in the image display region as a static image in a case where the absolute value of the difference is less than or equal to the threshold parameter.

For example, in the method for processing the display image provided by an embodiment of the present disclosure, the movable region moves from the first position to the second position, includes: allowing the movable region to move M pixel steps from the first position along a first direction; and M is an integer greater than zero.

For example, in the method for processing the display image provided by an embodiment of the present disclosure, in a case where a maximum step size of the movable region moving along the first direction is n rows or n columns of pixels, the threshold parameter is a product of the maximum step size and an average image feature value of each row or column of pixels in the image display region, and n is an integer greater than zero.

For example, the method for processing the display image provided by an embodiment of the present disclosure further includes at least two movement cycles. An (N)th movement cycle and an (N+1)th movement cycle respectively include X frames of display images in a one-to-one corresponding way; a position of an image display region where an (x)th frame display image is located in the (N+1)th movement cycle is identical to a position of an image display region where an (x)th frame display image is located in the (N)th movement cycle; and x is an integer greater than zero and less than or equal to X, N is an integer greater than zero, and X is an integer greater than zero.

For example, in the method for processing the display image provided by an embodiment of the present disclosure, the first image feature value is an image feature value of the display image in each frame in the (N)th movement cycle; and the second image feature value is an image feature value of the display image in each frame in the (N+1)th movement cycle.

For example, in the method for processing the display image provided by an embodiment of the present disclosure, the determining whether the display image displayed in the image display region is a static image based on the first image feature value and the second image feature value, includes: determining whether the image feature value of the display image in each frame in the (N)th movement cycle is in one-to-one correspondence with and equal to the image feature value of the display image in each frame in the (N+1)th movement cycle; in a case where the image feature value of the display image in each frame in the (N)th movement cycle is in one-to-one correspondence with and equal to the image feature value of the display image in each frame in the (N+1)th movement cycle, determining the display image displayed in the image display region as a static image; and in a case where the image feature value of the display image in each frame in the (N)th movement cycle is not in one-to-one correspondence with or equal to the image feature value of the display image in each frame in the (N+1)th movement cycle, determining the display image displayed in the image display region as a non-static image.

For example, in the method for processing the display image provided by an embodiment of the present disclosure, the movement cycle is time taken for the movable region to move from the first position and thencd back to the first position.

For example, in the method for processing the display image provided by an embodiment of the present disclosure, the first image feature value is brightness value or gray-scale value of the display image displayed in the image display region, and the second image feature value is brightness value or gray-scale value of the display image displayed in the image display region.

For example, in the method for processing the display image provided by an embodiment of the present disclosure, the image display region is a portion, which is not removed from a display screen during image rotation, of the movable region.

For example, the method for processing the display image provided by an embodiment of the present disclosure further includes reducing display brightness of the image display region In a case where the display image is determined as the static image.

At least an embodiment of the present disclosure further provides a display image processing device, including: a processor, a memory, and one or more computer program modules. The one or more computer program modules are stored in the memory and configured to be executed by the processor, and the one or more computer program modules include instructions which are executed by the processor to implement the method, provided by any one of the embodiments of the present disclosure, for processing the display image.

At least an embodiment of the present disclosure further provides a display device, including the display image processing device provided by any one of the embodiments of the present disclosure.

At least an embodiment of the present disclosure further provides a storage medium, for storing non-volatile computer readable instructions, and the non-volatile computer readable instructions are executed by a computer to implement the method, provided by any one of the embodiments of the present disclosure, for processing the display image.

BRIEF DESCRIPTION OF THE DRAWINGS

In order to clearly illustrate the technical solution of the embodiments of the present disclosure, the drawings of the embodiments will be briefly described in the following. It is obvious that the described drawings in the following are only related to some embodiments of the present disclosure and thus are not limitative of the present disclosure.

DETAILED DESCRIPTION

Figure 1A:
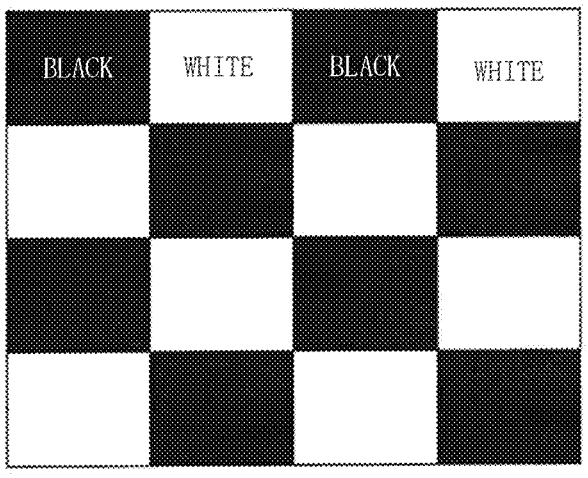
FIG. 1A is a schematic diagram of an image 1 displayed by a display.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", "coupled", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Hereinafter, various embodiments of the present disclosure will be described in detail with reference to the accompanying drawings. It should be noted that in the accompanying drawings, the same reference numerals indicate components having substantially the same or similar structures and functions, and repeated descriptions thereof will be omitted.

One of problems with the OLED (Organic Light-Emitting Diode) display technology is display afterimage. If a display shows a same image for a long time, when the current display image is switched to a next image, the original image will partially remain in the next image, and this phenomenon is described as the afterimage. One of reasons of afterimage generation is related to the drift of threshold voltage (Vth) of a transistor in an OLED pixel. Because different display gray scales cause different currents flowing through the drain electrode of the transistor in different display periods, the threshold voltage (Vth) of the transistor in the OLED pixel may generate different degrees of drift, thereby generating the afterimage on the display screen. In a slight case, the afterimage may gradually fade away, but if the static image is displayed for a long time or accumulated for a long time, it may cause irreversible permanent damage to the display.

The LCD (Liquid Crystal Display) display technology also has the afterimage problem, and one of reasons of afterimage generation is the polarization caused by the accumulation of impurity ions (for example, from a sealant or the like) in the liquid crystal layer on one side of the liquid crystal layer. The polarization will affect the deflection direction of liquid crystal molecules, thereby affecting the gray scale of the corresponding pixel and generating the afterimage.

Figure 1B:
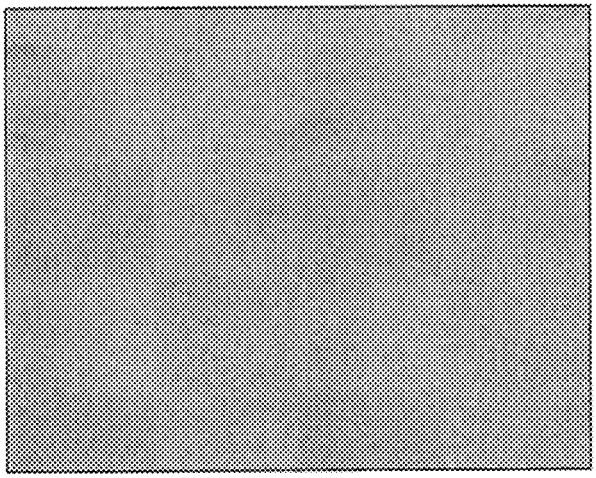
FIG. 1B is a schematic diagram of an image 2 to be displayed by the display.
Figure 1C:
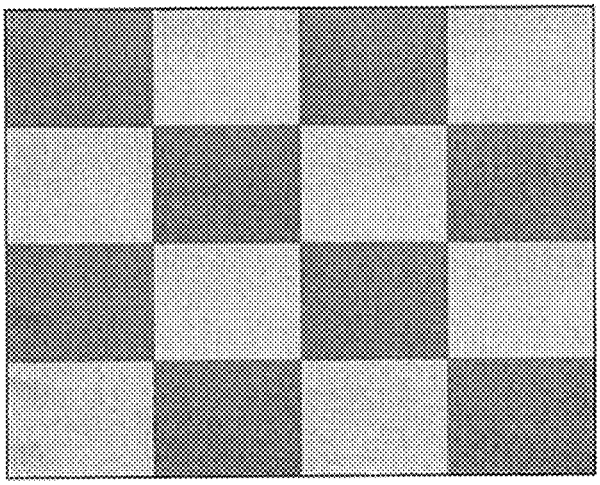
FIG. 1C is a schematic diagram of the image 2 actually displayed by the display.

For example, FIG. 1A is a schematic diagram of an image 1 displayed by a display, FIG. 1B is a schematic diagram of an image 2 to be displayed by the display, and FIG. 1C is a schematic diagram of the image 2 actually displayed by the display. After the image 1, for example, a black and white chessboard image as illustrated in FIG. 1A, is displayed for a long time by the display, when the image displayed by the display is switched to the image 2, for example, an image with a gray scale of 127 as illustrated in FIG. 1B, the chessboard image of the image 1 illustrated in FIG. 1A still partially remains, as illustrated in FIG. 1C, which is the display afterimage.

Image rotation is a common method for eliminating the afterimage, but in order to avoid large image rotation affecting the display effect, the amplitude of image rotation is usually not too large. However, because the size of the image display region where the static image is displayed is generally much larger than the amplitude of image rotation, and contents of adjacent pixels in the display image are similar in many application scenarios (e.g., display standby images, main login pages, etc.), the image rotation may not effectively solve the afterimage problem caused by the static image in some cases. Therefore, it is necessary to determine the existing static image in the image rotation state, and take corresponding measures based on the judgment result to avoid the afterimage.

An embodiment of the present disclosure provides a method for processing a display image in an image display region, and a part of the image display region or all of the image display region is a movable region. The method for processing the display image includes: in a case where the movable region is moved from a first position to a second position, obtaining a first image feature value of the display image displayed in the image display region where the movable region is at the first position; obtaining a second image feature value of the display image displayed in the image display region where the movable region is at the second position; and determining whether the display image displayed in the image display region is a static image based on the first image feature value and the second image feature value.

At least an embodiment of the present disclosure further provides a display image processing device, a display device and a storage medium corresponding to the method for processing the display image described above.

The method for processing the display image can determine the existing static image in the image rotation state by reasonably selecting the region to determine the static image, so as to avoid the afterimage of the display in the image rotation state, thereby preventing the afterimage from causing damage to the display and prolonging the service life of the display.

The embodiments of the present disclosure will be described in detail below with reference to the accompanying drawings.

Figure 2:
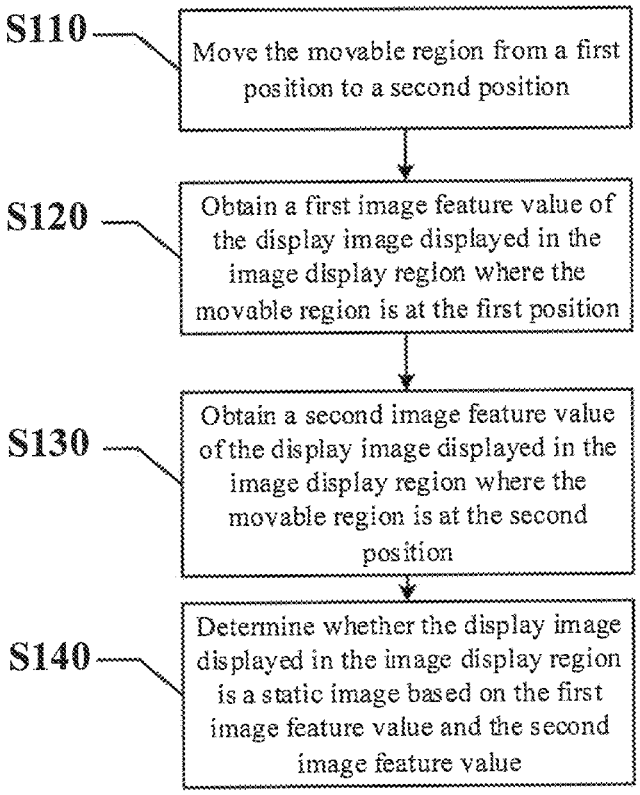
FIG. 2 is a flowchart of a method, provided by some embodiments of the present disclosure, for processing a display image displayed in an image display region.

An embodiment of the present disclosure provides a method for processing a display image in an image display region, and for example, the method can be applied to an OLED display device. As illustrated in FIG. 2, the method for processing the display image includes steps S110 to S140. For example, a part of the image display region or all of the image display region is a movable region for performing an image rotation operation to avoid the afterimage. Hereinafter, the method for processing the display image provided by the embodiments of the present disclosure will be described with reference to FIG. 2.

The step S110: moving the movable region from a first position to a second position.

This step S110 is the process of image rotation. For example, the process of image rotation can be a process of moving the movable region. For example, the movable region may be all or part of the image display region.

The display screen of the display device can be used for display output. For the above method, the entire display screen can be used as the image display region, or a part of the display screen can be used as the image display region according to requirements. The display screen of the display device can be configured, for example, to adopt various resolutions, such as 640×480, 1024×768, 1600×1200, or the like. In the embodiments of the present disclosure, the image display region may be processed as a whole, or the image display region may be divided into a plurality of regions, thereby selecting one of the plurality of regions for processing.

Figure 3:
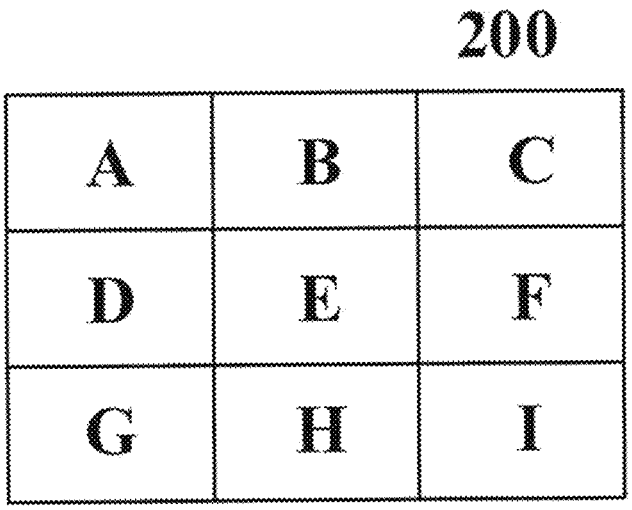
FIG. 3 is a schematic diagram of an OLED image display region.

For example, as illustrated in FIG. 3, the image display region 200 of an OLED display is divided into 9 image display regions in a 3×3 arrangement, which are respectively A, B, C . . . H, and I. For example, in a case where the OLED display stays at a start welcoming interface, the entire image display region 200 displays a static image. In this case, if the static image remains unchanged for a long time, after a certain period of time, for example, 10 to 30 minutes, the display screen is prone to appear the afterimage without performing any operation on the display image, thereby causing damage to the display. In this case, the entire image display region can be selected as the movable region.

For another example, as illustrated in FIG. 3, in a case where the OLED display is switched to an application interface, for example, a navigation application interface, the image display regions A, B, C, D, and G are used to display the indication image of the navigation operation, and the image display regions A, B, C, D, and G display a fixed static image. The remaining regions E, F, H, and I of the image display region 200 display navigation map information, and the image display regions E, F, H, and I update the display image in real time according to position information, that is, the image display regions E, F, H, and I display dynamic images. In this case, in order to avoid the afterimage, one or all of the regions A, B, C, D, and G can be selected as the movable region to be operated in the method for processing the display image of the present example.

It should be noted that the movable region in the image display region is not limited to a portion having a regular shape and may be a portion having an irregular shape. In the embodiments of the present disclosure, the entire image display region is taken as an example of the movable region in the above method. The following embodiments are the same, and details are not described again. For example, as illustrated in FIG. 4B, the movable region 102 may be the entire image display region, and the entire image display region is an overall image displayed by the entire display screen 101 prior to the image rotation operation. It should be noted that the size of the movable region 102 illustrated in FIG. 4B is slightly smaller than the size of the display screen 101 for convenience of representation.

In the method for processing the display image provided by the embodiments of the present disclosure, for example, the first position is a position prior to the image rotation, and the second position is a position subsequent to the image rotation. It should be noted that the second position may be a position where the movable region is moved once from the first position, that is, a position adjacent to the first position, and the second position also may be a position after multiple movements, for example, a position, where the first position is located, after a plurality of movements. The embodiments of the present disclosure are not limited in this aspect.

Figure 4A:
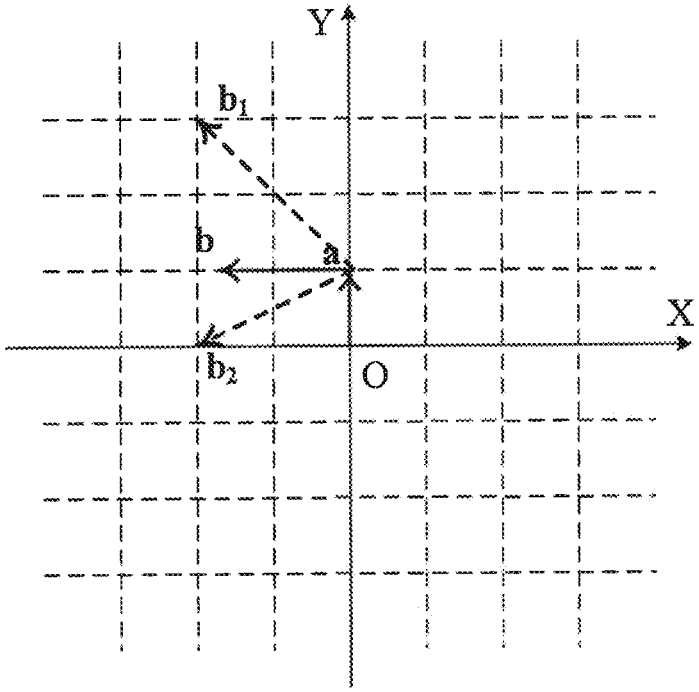
FIG. 4A is a schematic diagram of a movement trajectory of a method, provided by some embodiments of the present disclosure, for processing a display image.
Figure 4B:
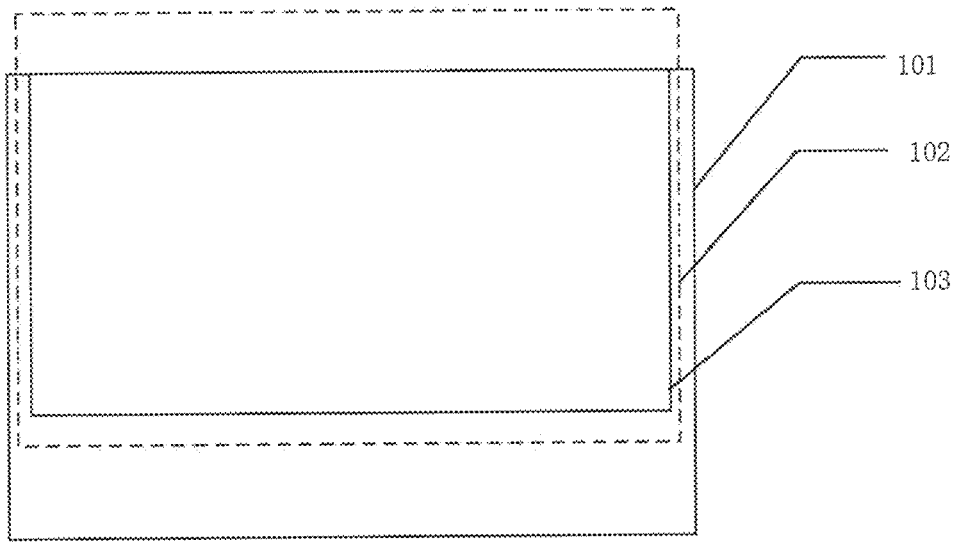
FIG. 4B is a schematic diagram of a display image at a first position in a method for processing the display image provided by some embodiments of the present disclosure.
Figure 4C:
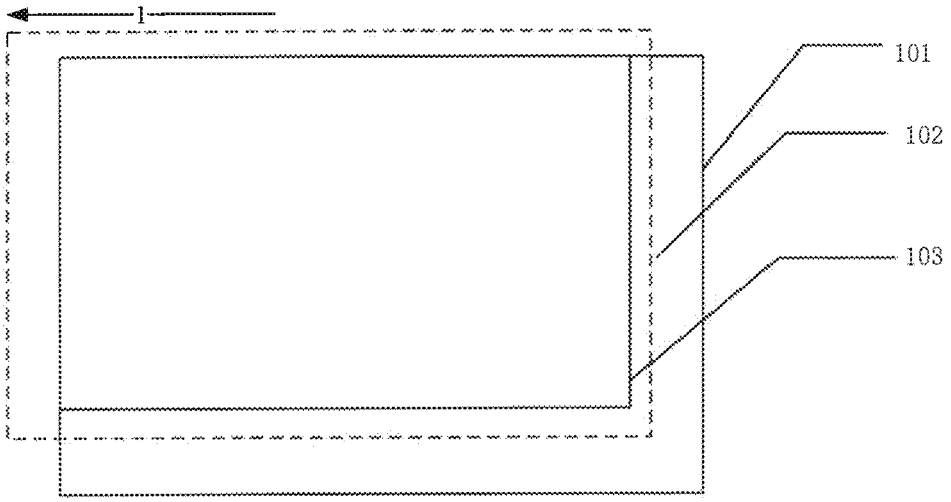
FIG. 4C is a schematic diagram of a display image moving to a second position along the movement trajectory illustrated in FIG. 4A in a method for processing the display image provided by some embodiments of the present disclosure.

For example, the image display region 103 illustrated in FIG. 4B and FIG. 4C is a portion, which is not removed from the display screen 101 throughout the image rotation process, of the movable region 102, and the display image displayed in the image display region is determined whether to be a static image. For example, in one example, the position where the image display region 103 is located in FIG. 4B corresponds to the first position of the movable region 102, and the position where the image display region 103 is located in FIG. 4C corresponds to the second position of the movable region 102. It should be noted that during the image rotation, as the movement of the movable region 102, the size of the image display region 103 does not change, but the position of the image display region 103 changes accordingly.

For example, as illustrated in FIG. 4B and FIG. 4C, the movable region 102 moves from the first position to the second position, that is, moves from the position illustrated in FIG. 4B to the position illustrated in FIG. 4C along a direction of an arrow 1 illustrated in FIG. 4C. For example, the image display region 103 can be moved to the second position illustrated in FIG. 4C by moving the movable region 102 from the first position by M (M is an integer greater than zero) pixel steps along a first direction.

It should be noted that, in various embodiments of the present disclosure, for example, as illustrated in FIG. 4A, in order to facilitate the description of the moving direction, a (virtual) rectangular coordinate system is drawn, the X-axis and the Y-axis intersect at the origin O, and the origin O indicates the initial position where the movable region starts moving. In FIG. 4A, a plurality of dashed lines respectively parallel to the X-axis and the Y-axis are drawn, and these dashed lines respectively intersect to divide the region illustrates in FIG. 4A into a plurality of square regions. The points at which the dashed lines intersect are pixel points, and the side length of the square is defined as one-unit pixel step size. For description of the movement of the movable region, one sub-pixel in the movable region is taken as a description object for description, other sub-pixels are identical thereto, and the path through which a sub-pixel moves is defined as a movement trajectory. The following embodiments are the same in this aspect.

In addition, although the figure is described by taking a standard matrix pixel array as an example, those skilled in the art may understand that each sub-pixel may also be in other arrangements, for example, a triangular array (Δ), that is, three adjacent sub-pixels respectively at three vertices of such as an equilateral triangle.

For example, with reference to FIG. 4A and FIG. 4B, a certain sub-pixel in the movable region 102 illustrated in FIG. 4B is at a pixel point a, and the sub-pixel moves 2 pixel steps to a pixel point b along the direction of the X-axis, that is, the direction of the X-axis is the first direction and M=2, so that the movable region 102 moves from the first position illustrated in FIG. 4B to the second position illustrated in FIG. 4C along the direction of the arrow 1 illustrated in FIG. 4C. For example, in this example, the first position and the second position are positions where the display image is respectively located in two adjacent frames. It should be noted that the first position may be the initial position, or may be other position. Certainly, the first direction may also be other direction, for example, the direction of the Y-axis. It should be noted that the size of M pixel steps which is moved may also be other value, for example, M=1, etc., and the embodiments of the present disclosure are not limited in this aspect. The following embodiments are the same, and details are not described again.

It should be noted that the movable region may also move along the direction of $ab_1$ or $ab_2$ illustrated in FIG. 4A, and $ab_1$ and $ab_2$ are illustrated by dashed lines with arrows in FIG. 4A. The embodiments of the present disclosure are not limited in this aspect.

For example, the movable region moves at least one pixel step from the initial position O along the direction of the arrow Oa, then moves at least one pixel step along the direction of the arrow ab or dashed arrow $ab_1$ or $ab_2$ which intersects the arrow Oa, and then moves at least one pixel step along the direction which intersects the arrow ab or dashed arrow $ab_1$ or $ab_2$ and is opposite to the direction of the arrow Oa . . . , so that rotation of the image is implemented.

The step S120: obtaining a first image feature value of the display image displayed in the image display region where the movable region is at the first position.

Figure 5:
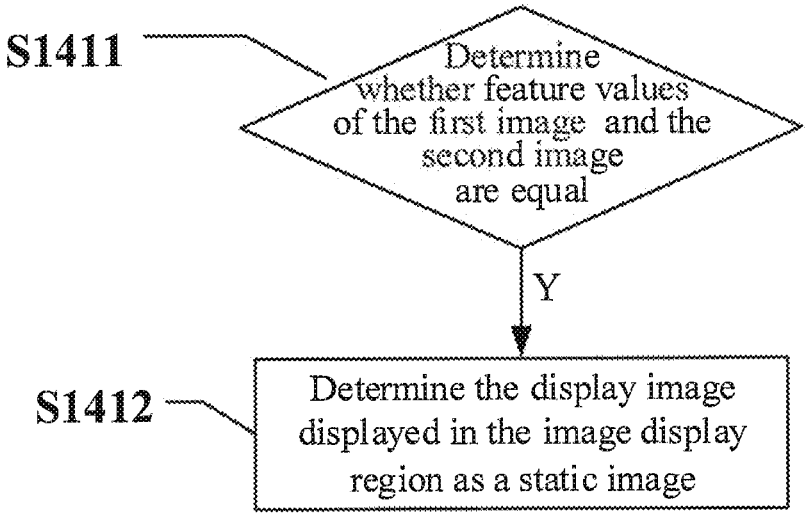
FIG. 5 is a flowchart of an example of a step S140, illustrated in FIG. 2, of the method for processing the display image.

For example, for the example illustrated in FIG. 5, the image display region may be a part of the entire image display region, for example, as illustrated in FIG. 4B or FIG. 4C, and in this case, the image display region 103 is a part of the movable region 102. For the example illustrated in FIG. 6 or FIG. 7, the image display region may be the entire image display region (i.e., the display screen 101).

For example, in the example illustrated in FIG. 5, the first image feature value is the total brightness of the display image displayed in the image display region 103 where the movable region 102 is at the first position, and for example, the first position is a position, where the movable region 102 moves during image rotation, illustrated in FIG. 4B. For example, in the example illustrated in FIG. 6 or FIG. 7, the first image feature value is a total brightness of the display image displayed in the entire image display region (i.e., the display screen 101) where the movable region 102 is at the first position. The display gray scale of each sub-pixel in the image display region corresponds to one brightness value, and for example, the first image feature value can be obtained by calculating the sum of the brightness corresponding to the gray scale of each of the sub-pixels in the corresponding image display region. It should be noted that the first image feature value may also be a total gray-scale value of the display image displayed in the image display region where the movable region 102 is at the first position. The embodiments of the present disclosure are not limited in this aspect, as long as the definition of "the image feature value" is the same in different steps of a same method.

The step S130: obtaining a second image feature value of the display image displayed in the image display region where the movable region is at the second position.

For example, in the example illustrated in FIG. 5, the second image feature value is the total brightness of the display image displayed in the image display region 103 where the movable region 102 is at the second position, and for example, the second position is a position, where the movable region 102 moves during image rotation, illustrated in FIG. 4C. For example, in the example illustrated in FIG. 6 or FIG. 7, the second image feature value is a total brightness of the display image displayed in the entire image display region where the movable region 102 is at the second position. Similarly, the display gray scale of each sub-pixel in the image display region corresponds to one brightness value, and for example, the second image feature value can be obtained by calculating the sum of the brightness corresponding to the gray scale of each of the sub-pixels in the corresponding image display region. It should be noted that the second image feature value may also be a total gray-scale value of the display image displayed in the image display region where the movable region 102 is at the second position. The embodiments of the present disclosure are not limited in this aspect.

For example, the first image feature value and the second image feature value may be stored in a memory of an OLED display panel and can be read from the memory by the OLED display panel when needed. The memory may include one or more computer program products, and the computer program products may include various forms of computer readable storage mediums. For example, the computer readable storage medium may be a volatile memory and/or non-volatile memory, such as a magnetic storage medium, a semiconductor storage medium, etc. The memory storage may be provided separately, or may be included in, for example, a driving IC.

The step S140: determining whether the display image displayed in the image display region is a static image based on the first image feature value and the second image feature value.

For example, FIG. 5, FIG. 6, and FIG. 7 respectively show a specific method for determining whether the display image displayed in the image display region is a static image, and the method for determination will be described in detail below.

It should be noted that after the image is rotated, if the display image displayed in the image display region is a non-static image, the afterimage will not appear, so that the display will not be damaged. After the image is rotated, if the display image displayed in the image display region is a static image, the afterimage problem can be overcome or alleviated by reducing the display brightness of the image display region, to avoid or reduce the damage of the afterimage to the display device, thereby prolonging the service life of the display. The following embodiments are the same, and details are not described again.

It should be noted that each step in various embodiments of the present disclosure may be implemented by a central processing unit (CPU) or other form of a processing unit having data processing capability and/or instruction executing capability. For example, the processing unit may be a universal processor or a dedicated processor, the processing unit and may be a processor based on an X86 or ARM structure. The following embodiments are the same, and details are not described again.

FIG. 5 is a flowchart of a method for determining a static image provided by an example of an embodiment of the present disclosure. That is, FIG. 5 is an operation flowchart of an example of the step S140 illustrated in FIG. 2. For example, in this example, the image display region is the portion, which is not removed from the display screen 101 throughout the image rotation, of the movable region 102, that is, the image display region 103 illustrated in FIG. 4B or FIG. 4C.

As illustrated in FIG. 5, the method for determining the static image includes steps S1411 and S1412.

The step S1411: determining whether the first image feature value and the second image feature value are equal; and if yes, the step S1412 is performed.

For example, the first image feature value is the total brightness of the display image displayed in the image display region 103 where the movable region 102 is at the first position; and the second image feature value is the total brightness of the display image displayed in the image display region 103 where the movable region 102 is at the second position. For example, in this example, the first image feature value and the second image feature value are respectively the total brightness of the display image in two adjacent frames in the image display region 103.

For example, the first image feature value and the second image feature value are equal, that is, after the rotation, the brightness values of the display image in the two frames are exactly the same, and therefore, the display image displayed in the image display region is determined to be a static image.

The step S1412: determining the display image displayed in the image display region as a static image.

For example, in a case where the first image feature value and the second image feature value are equal, it is determined that the display image displayed in the image display region 103 is a static image. In this case, the afterimage problem can be overcome or alleviated by reducing the display brightness of the image display region.

Therefore, in this example, the region for determining the static image is reasonably selected, and the existing static image in the image rotation state is determined to prevent the display from generating the afterimage in the image rotation state, thereby preventing the afterimage from causing damage to the display and prolonging the service life of the display.

Figure 6:
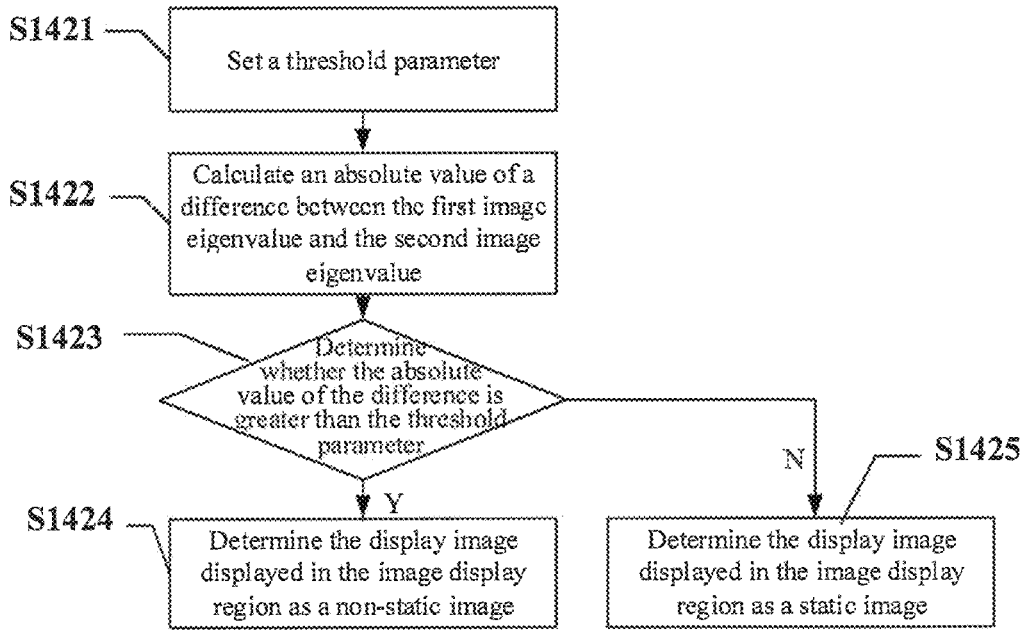
FIG. 6 is a flowchart of another example of the step S140, illustrated in FIG. 2, of the method for processing the display image.

FIG. 6 is a flowchart of a method for determining a static image provided by another example of an embodiment of the present disclosure. That is, FIG. 6 is an operation flowchart of another example of the step S140 illustrated in FIG. 2. For example, in this example, the first image feature value and the second image feature value are respectively the total brightness of the display image in two adjacent frames, that is, the first position and the second position of the movable region 102 are adjacent positions. For example, in this example, the image display region is indicated as the entire image display region (i.e., display screen 101).

As illustrated in FIG. 6, the method for determining the static image includes steps S1421 to S1425.

The step S1421: setting a threshold parameter.

For example, in a case where a maximum step size of the movable region 102 moving along the first direction is n (n is an integer greater than zero) rows or n columns of pixels, the threshold parameter is a product of the maximum step size and an average image feature value of each row or column of pixels in the image display region. For example, the average image feature value of each row or column of pixels in the entire image display region can be obtained by counting the histogram of the display image in the image display region. For example, the average image feature value may be an average brightness value of the display image. For example, the maximum step size of the movable region 102 moving along the first direction is 2 rows of pixels per rotation, and the entire image display region includes, for example, 2160 rows of pixels in total, so that the average brightness value of these 2 rows of pixels can be used as the threshold parameter. For example, the threshold parameter A can be expressed as:

$$A=Lum1*(2/2160),$$

Lum1 represents the total brightness of the display image displayed in the entire image display region where the movable region 102 is at the first position, that is, the first image feature value of the display image displayed in the entire image display region where the movable region 102 is at the first position.

It should be noted that, in the case where the maximum step size of the movable region 102 moving along the first direction is n rows or n columns of pixels, the brightness value of the n rows or n columns of pixels of the movable region 102 may also be used as the threshold parameter A, and for example, the brightness value of the n rows or n columns of pixels may be obtained by statistically summing the brightness values corresponding to gray scales of the n rows or n columns of pixels in the original display image. For example, the maximum step size of the movable region 102 moving along the first direction is 2 rows of pixels per rotation, and the brightness value of these 2 rows of pixels in the original display image can be used as the threshold parameter A. The embodiments of the present disclosure are not limited in this aspect.

It should be noted that, because the total brightness of the display image in each frame may be different, in order to avoid that the first image feature value Lum1 used for calculating the threshold parameter A is small, when calculating the threshold parameter, for example, the threshold parameter A can be selected as: A=Lum1*(1/1024) because of 2/2160<1/1024, thereby ensuring the accuracy of determination of the static image. It should be noted that the maximum step size of the movable region 102 moving along the first direction per rotation depends on the specific situation, and the embodiments of the present disclosure are not limited in this aspect.

The step S1422: calculating an absolute value of a difference between the first image feature value and the second image feature value.

For example, the absolute value of the difference between the first image feature value and the second image feature value may be expressed as:

$$B=|Lum1-Lum2|,$$

Lum2 represents the total brightness of the display image displayed in the entire image display region where the movable region 102 is at the second position, that is, the second image feature value of the display image displayed in the entire image display region where the movable region 102 is at the second position.

For example, the difference B between the first image feature value and the second image feature value is a change in brightness of the display image in the entire image display region where the movable region 102 is rotated from the first position illustrated in FIG. 4B to the second position illustrated in FIG. 4C.

The step S1423: determining whether the absolute value of the difference is greater than the threshold parameter. If yes, the step S1424 is performed; and if no, the step S1425 is performed.

For example, the absolute value B of the difference between the first image feature value and the second image feature value obtained in the step S1422, and the value of the threshold parameter A obtained in the step S1421 are determined.

For example, in a case where the absolute value B of the difference is greater than the threshold parameter A, the change in brightness of the display image where the movable region 102 is rotated from the first position to the second position is greater than the brightness value of the pixel which has the maximum step size (e.g., the maximum step size during rotating movement) in the display image prior to the rotation. That is, after the image is rotated, the display image in the two frames is largely changed, and therefore, the display image displayed in the image display region 103 is determined as a non-static image.

For example, in a case where the absolute value B of the difference is less than or equal to the threshold parameter A, the change in brightness of the display image where the display image displayed in the image display region 103 is rotated from the first position to the second position is less than or equal to the brightness value of the pixel which has the maximum step size (e.g., the maximum step size during rotating movement) in the display image prior to the rotation. That is, after the image is rotated, the display image in the two frames is basically not much changed. Therefore, the display image displayed in the image display region 103 is determined as a static image, and the brightness of the image display region is reduced, so that the afterimage of the display in the image rotation state can be avoided, thereby preventing the afterimage from causing damage to the display and prolonging the service life of the display.

The step S1424: determining the display image displayed in the image display region as a non-static image.

The step S1425: determining the display image displayed in the image display region as a static image.

For example, the threshold parameter A and the absolute value B of the difference can be stored in a memory of the OLED display panel, and the threshold parameter A and the absolute value B of the difference can be read from the memory by the OLED display panel when needed. The memory may include one or more computer program products, and the computer program products may include various forms of computer readable storage mediums. For example, the computer readable storage medium may be a volatile memory and/or non-volatile memory, such as a magnetic storage medium, a semiconductor storage medium, etc.

Figure 7:
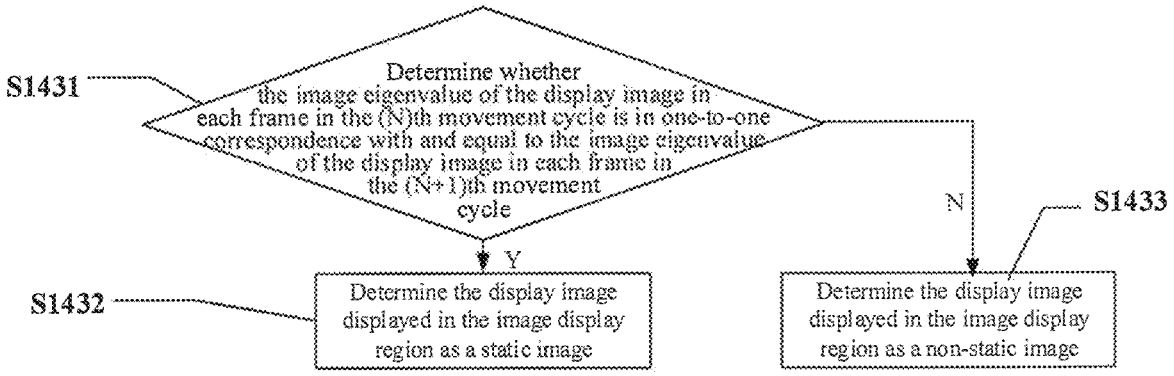
FIG. 7 is a flowchart of further still another example of the step S140, illustrated in FIG. 2, of the method for processing the display image.

FIG. 7 is a flowchart of a method for determining a static image provided by further still another example of an embodiment of the present disclosure. That is, FIG. 7 is an operation flowchart of further still another example of the step S140 illustrated in FIG. 2. For example, in this example, at least two movement cycles are included. For example, the movement cycle includes the time taken for the movable region 102 to move from the first position to back to the first position. For example, an (N)th (N is an integer greater than zero) movement cycle and an (N+1)th movement cycle are included in this example. For example, each movement cycle includes X (X is an integer greater than zero) frames of display image, that is, the display image displayed in the image display region where the movable region 102 is located at X different positions, respectively. For example, a position of the movable region where an (x)th (x is an integer greater than 0 and less than or equal to X) frame display image is located in the (N+1)th movement cycle is identical to a position of the movable region where an (x)th frame display image is located in the (N)th movement cycle. For example, in this example, the image display region is represented as the entire image display region (i.e., display screen 101).

In this example, the position, where the (x)th frame display image is located in the (N)th movement cycle, of the movable region indicates the first position of the movable region, and the position, where the (x)th frame display image is located in the (N+1)th movement cycle, of the movable region indicates the second position of the movable region. In this example, the first position where the movable region 102 is located in the (N)th movement cycle is identical to the second position where the movable region 102 is located in the (N+1)th movement cycle. In this example, the first image feature value represents the brightness value of the (x)th frame display image in the (N)th movement cycle, and the second image feature value represents the brightness value of the (x)th frame display image in the (N+1)th movement cycle.

Figure 8A:
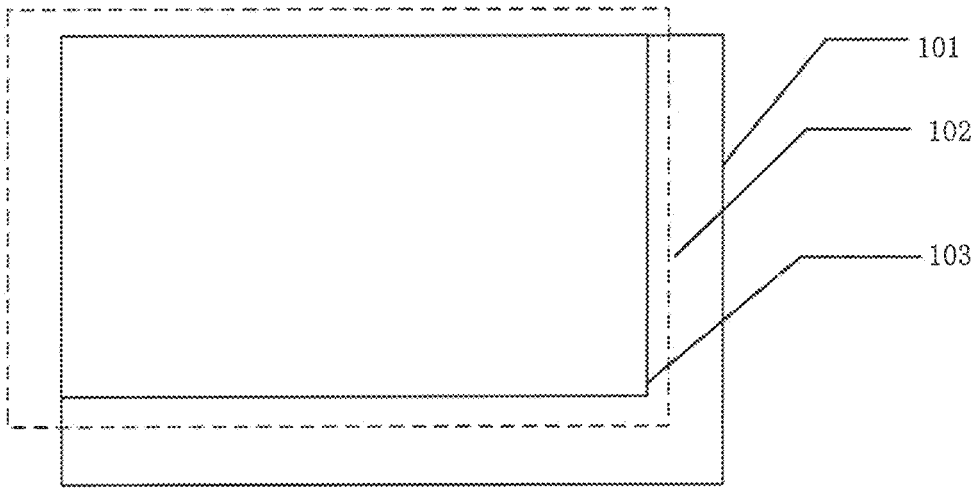
FIG. 8A-FIG. 8D are schematic diagrams of a display image moving to four limit positions during image rotation.
Figure 8B:
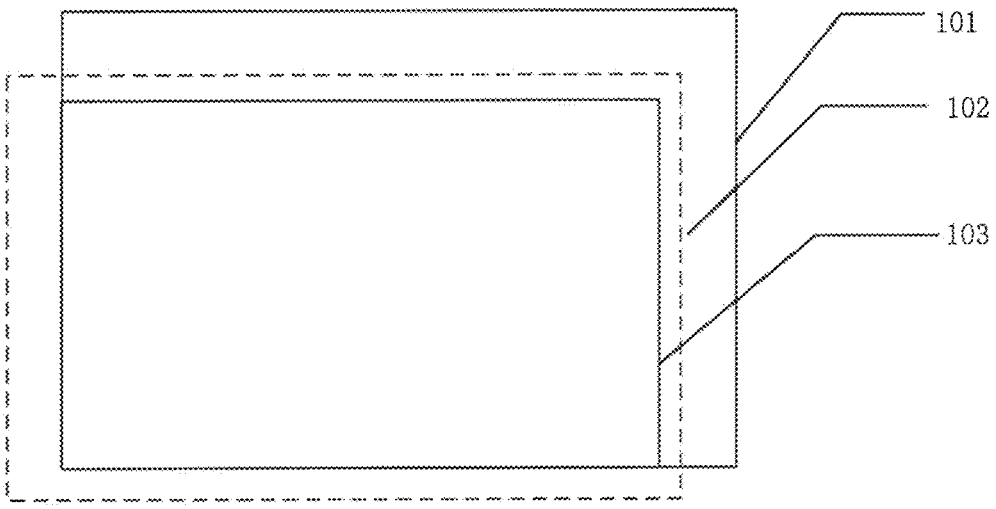
Figure 8C:
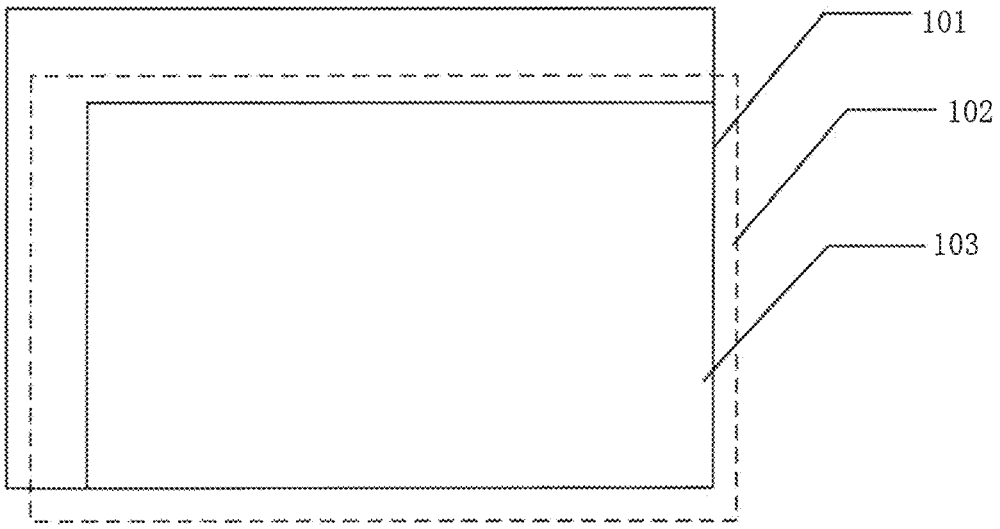
Figure 8D:
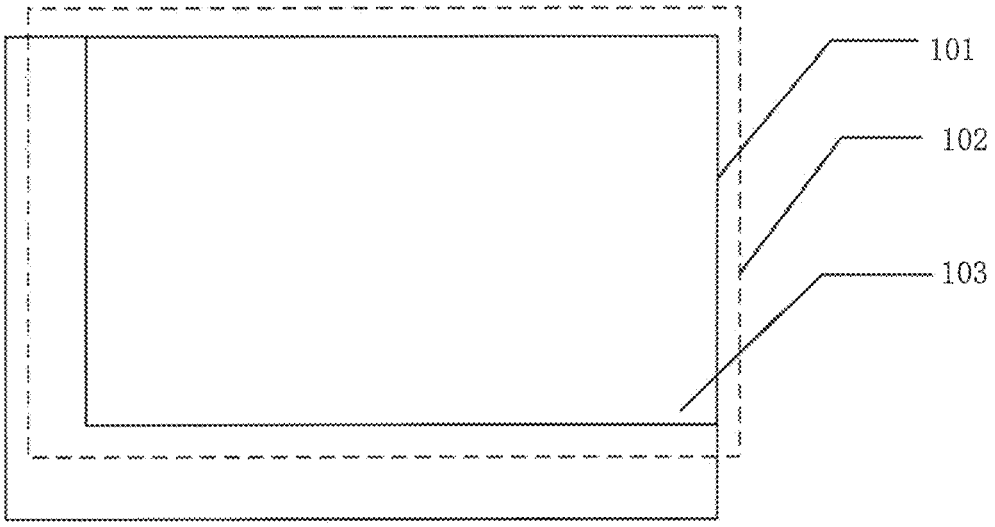

It should be noted that, because frames of display image are included in each cycle, for the convenience of calculation, an arbitrary number of frames in one cycle may be selected to perform image feature value calculation. For example, in a case where X=4, that is, 4 frames of the display image are respectively selected from the (N)th movement cycle and the (N+1)th movement cycle, and for example, the display image of each of four limit positions as illustrated in FIG. 8A to FIG. 8D is respectively selected from each cycle. For example, FIG. 8A is a schematic diagram of the movable region 102 moving to an upper left corner of the display screen, FIG. 8B is a schematic diagram of the movable region 102 moving to a lower left corner of the display screen, FIG. 8C is a schematic diagram of the movable region 102 moving to a lower right corner of the display screen, and FIG. 8D is a schematic diagram of the movable region 102 moving to an upper right corner of the display screen.

As illustrated in FIG. 7, the method for determining the static image includes steps S1431 to S1433.

The step S1431: determining whether the image feature value of the display image in each frame in the (N)th movement cycle is in one-to-one correspondence with and equal to the image feature value of the display image in each frame in the (N+1)th movement cycle. If yes, the step S1432 is performed; and if no, the step S1433 is performed.

For example, the image feature value of the display image in each frame in the (N)th movement cycle is stored in a frame brightness queue, and the image feature value of the display image in each frame in the (N+1)th movement cycle is stored in another frame brightness queue. For example, by comparing image feature values in the two frame brightness queues of the same specification one by one, it can be determined whether the image feature value of the display image in each frame in the (N)th movement cycle and the image feature value of the display image in each frame in the (N+1)th movement cycle are in one-to-one correspondence and equal.

For example, if the image feature value of the display image in each frame in the (N)th movement cycle and the image feature value of the display image in each frame in the (N+1)th movement cycle are in one-to-one correspondence and equal, the display image does not change during the two movement cycles, so that a static image is determined. If the image feature value of the display image in each frame in the (N)th movement cycle and the image feature value of the display image in each frame in the (N+1)th movement cycle are not in one-to-one correspondence or equal, and for example, the image feature value of the display image in the (x)th frame in the (N+1)th movement cycle and the image feature value of the display image in the (x)th frame in the (N)th movement cycle are not equal, the display image changes during the two movement cycles, so that a non-static image is determined.

For example, if the display image displayed in the image display region is a static image, the brightness of the image display region is reduced to overcome the afterimage, thereby preventing the afterimage from causing damage to the display and prolonging the service life of the display.

The step S1432: determining the display image displayed in the image display region as a static image.

The step S1433: determining the display image displayed in the image display region as a non-static image.

Figure 9:
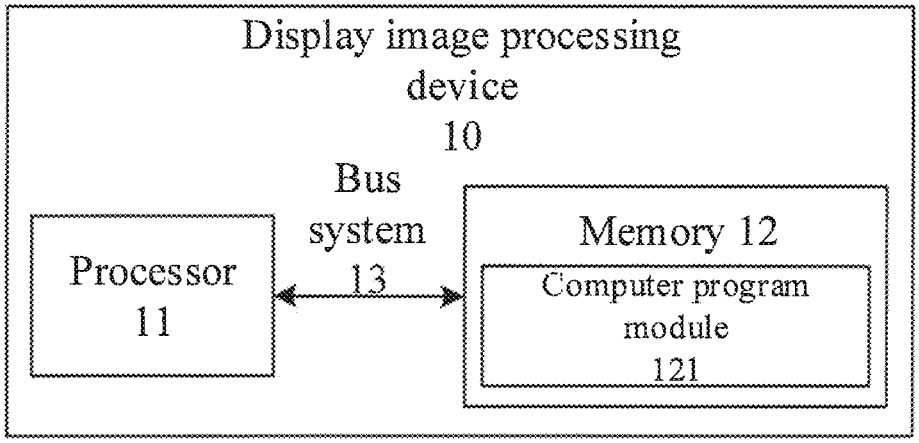
FIG. 9 is a schematic diagram of a display image processing device provided by some embodiments of the present disclosure.

At least one embodiment of the present disclosure further provides a display image processing device, which is configured to perform the above-described method for processing the display image provided by the embodiments of the present disclosure. For example, the display image processing device 10 can be implemented by software, firmware, hardware, or any combination thereof. FIG. 9 is a schematic block diagram of an exemplary display image processing device 10 provided by an embodiment of the present disclosure. For example, the display image processing device 10 as illustrated in FIG. 9 includes a processor 11, a memory 12, and one or more computer program modules 121. For example, the processor 11 and the memory 12 are connected by a bus system 13. For example, the one or more computer program modules 121 can be stored in the memory 12. For example, the one or more computer program modules 121 can include instructions which are executed to implement the method for processing the display image described above. For example, the instructions in the one or more computer program modules 121 can be executed by the processor 11. For example, the bus system 13 may be a conventional serial communication bus, a conventional parallel communication bus, etc., and the embodiments of the present disclosure are not limited in this aspect. It should be noted that components and structures of the display image processing device 10 illustrated in FIG. 9 are merely exemplary and not limiting, and the display image processing device 10 may have other components and structures according to requirements.

The technical effects of the display image processing device 10 may be with reference to the technical effects of the method for processing the display image provided in the embodiments of the present disclosure, and details are not described herein again.

Figure 10:
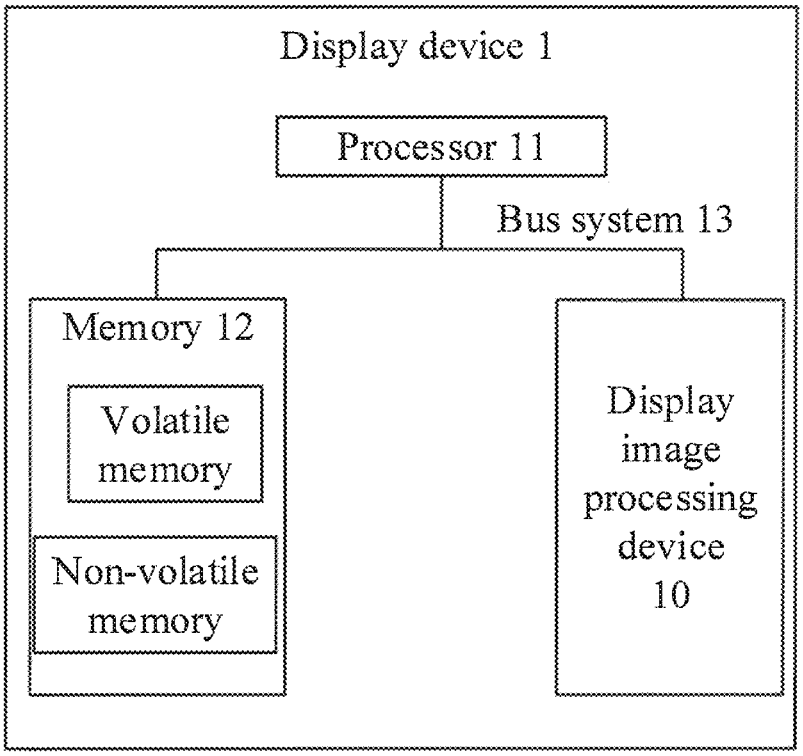
FIG. 10 is a schematic diagram of a display device provided by some embodiments of the present disclosure.

At least one embodiment of the present disclosure further provides a display device 1. The display device 1 includes the display image processing device 10 provided by any one of the embodiments of the present disclosure. For example, the display device 1 includes the display image processing device 10 as illustrated in FIG. 9. FIG. 10 is a schematic block diagram of the display device 1 provided by an embodiment of the present disclosure. For example, as illustrated in FIG. 10, the display device 1 includes the processor 11, the memory 12, and the display image processing device 10.

For example, the display image processing device 10 can determine whether a static image exists in the image rotation state, and the display image processing device 10 can adjust the brightness of the display screen.

For example, the display device 1 may be an OLED display screen, a micro LED display screen, a liquid crystal display (LCD) screen, a liquid crystal on silicon (LCOS)

display screen, a plasma display panel (PDP), an electronic paper display screen, etc., and the embodiments of the present disclosure are not limited in this aspect.

For example, these components are interconnected by the bus system 13 and/or other forms of coupling mechanisms (not shown). For example, the bus system 13 can be a conventional serial communication bus or a conventional parallel communication bus, and the embodiments of the present disclosure are not limited in this aspect. It should be noted that components and structures of the display device 1 illustrated in FIG. 10 are merely exemplary and not limiting, and the display device 1 may have other components and structures according to requirements.

For example, the processor 11 may be a central processing unit (CPU) or other forms of processing units having data processing capabilities and/or instruction executing capabilities, may be a universal processor or a dedicated processor, and may control other components in the display device 1 to perform desired functions. The memory 12 may include one or more computer program products, and the computer program products may include various forms of computer readable storage mediums, such as volatile memories and/or non-volatile memories. The volatile memory may include, for example, a random access memory (RAM) and/or a cache, or the like. The non-volatile memory may include, for example, a read-only memory (ROM), a hard disk, a flash memory, or the like. One or more computer program instructions can be stored in the computer readable storage medium, and the processor 11 may execute these program instructions to implement the functions (implemented by the processor 11) in the embodiments of the present disclosure and/or other desired functions, for example, determination of a static image and processing of the display image. Various applications and various data, such as threshold parameters and various data used and/or generated by the applications, etc., may further be stored in the computer readable storage medium.

It should be noted that, for the sake of clarity, all the constituent units of the display device are not given. In order to implement the necessary functions of the display device, those skilled in the art may improve and set other constituent units not shown according to specific requirements, and the embodiments of the present disclosure are not limited in this aspect.

The technical effects of the display device 1 may be with reference to the technical effects of the method for processing the display image provided in the embodiments of the present disclosure, and details are not described herein again.

Figure 11:
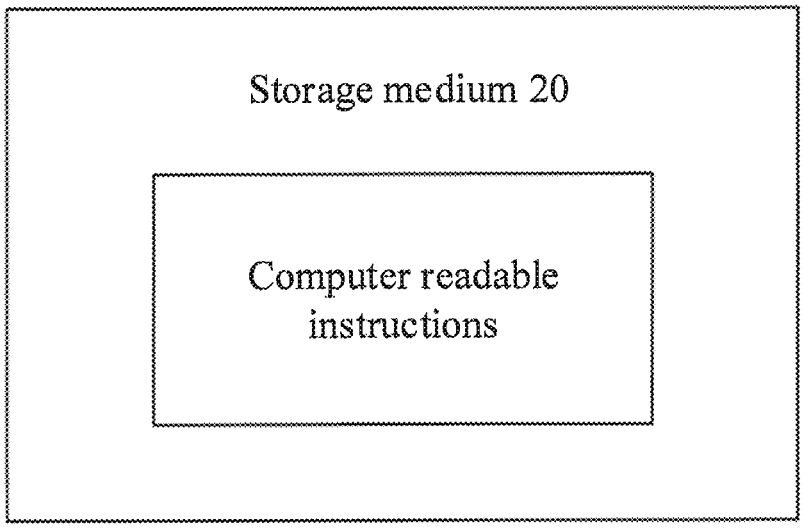
FIG. 11 is a schematic diagram of a storage medium provided by some embodiments of the present disclosure.

At least one embodiment of the present disclosure further provides a storage medium 20. For example, as illustrated in FIG. 11, the storage medium 20 is used for storing non-volatile computer readable instructions, and the non-volatile computer readable instructions are executed by a computer (including a processor) to implement the method for processing the display image provided by any one of the embodiments of the present disclosure.

For example, the storage medium can be any combination of one or more computer readable storage mediums. For example, one computer readable storage medium includes computer readable program codes for adjusting brightness, and another computer readable storage medium includes computer readable program codes for determining an existing static image. For example, in a case where the program codes are read by the computer, the computer can execute the program codes stored in the computer storage medium, thereby implementing the method for processing the display image provided by any one of the embodiments of the present disclosure, for example implementing the operation method for determining the static image, adjusting brightness, etc.

For example, the storage medium may include a memory card of a smart phone, a storage component of a tablet computer, a hard disk of a personal computer, a random access memory (RAM), a read-only memory (ROM), an erasable programmable read-only memory (EPROM), a portable compact disk read-only memory (CD-ROM), a flash memory, or any combination of the above storage mediums, and may also be other suitable storage mediums.

The following statements should be noted:

(1) The accompanying drawings involve only the structure(s) in connection with the embodiment(s) of the present disclosure, and other structure(s) can be referred to common design(s).

(2) In case of no conflict, features in one embodiment or in different embodiments can be combined to obtain new embodiments.

What have been described above are only specific implementations of the present disclosure, the protection scope of the present disclosure is not limited thereto, and the protection scope of the present disclosure should be based on the protection scope of the claims.

What is claimed is:

1. A method for processing a display image in an image display region, wherein a part of the image display region or all of the image display region is a movable region, and the method for processing the display image comprises:

in a case where the movable region is moved from a first position to a second position, obtaining a first image feature value of the display image displayed in the image display region where the movable region is at the first position;

obtaining a second image feature value of the display image displayed in the image display region where the movable region is at the second position; and determining whether the display image displayed in the image display region is a static image based on the first image feature value and the second image feature value, the first image feature value and the second image feature value are brightness value of the display image displayed in the image display region, wherein the method for processing the display image further comprises:

setting a threshold parameter;

wherein the determining whether the display image displayed in the image display region is a static image based on the first image feature value and the second image feature value, comprises:

calculating an absolute value of a difference between the first image feature value and the second image feature value;

determining the display image displayed in the image display region as a non-static image in a case where the absolute value of the difference is greater than the threshold parameter; and determining the display image displayed in the image display region as a static image in a case where the absolute value of the difference is less than or equal to the threshold parameter;

wherein the movable region is moved from the first position to the second position, comprises:

allowing the movable region to move M pixel steps from the first position along a first direction; and wherein in a case where a maximum step size of the movable region moving along the first direction is n rows or n columns of pixels, the threshold parameter is a product of the maximum step size and an average image feature value of each row or column of pixels in the image display region, and M is an integer greater than zero, n is an integer greater than zero.

2. The method for processing the display image according to claim 1, wherein the determining whether the display image displayed in the image display region is a static image based on the first image feature value and the second image feature value, comprises:

determining whether the first image feature value and the second image feature value are equal; and determining the display image displayed in the image display region as a static image in a case where the first image feature value and the second image feature value are equal.

3. The method for processing the display image according to claim 1, comprising at least two movement cycles, wherein an (N)th movement cycle and an (N+1)th movement cycle respectively comprise X frames of display images in a one-to-one corresponding way;

a position of an image display region where an (x)th frame display image is located in the (N+1)th movement cycle is identical to a position of an image display region where an (x)th frame display image is located in the (N)th movement cycle; and x is an integer greater than zero and less than or equal to X, N is an integer greater than zero, and X is an integer greater than zero.

4. The method for processing the display image according to claim 3, wherein the first image feature value is an image feature value of the display image in each frame in the (N)th movement cycle; and the second image feature value is an image feature value of the display image in each frame in the (N+1)th movement cycle.

5. The method for processing the display image according to claim 4, wherein the determining whether the display image displayed in the image display region is a static image based on the first image feature value and the second image feature value, comprises:

determining whether the image feature value of the display image in each frame in the (N)th movement cycle is in one-to-one correspondence with and equal to the image feature value of the display image in each frame in the (N+1)th movement cycle;

in a case where the image feature value of the display image in each frame in the (N)th movement cycle is in one-to-one correspondence with and equal to the image feature value of the display image in each frame in the (N+1)th movement cycle, determining the display image displayed in the image display region as a static image; and in a case where the image feature value of the display image in each frame in the (N)th movement cycle is not in one-to-one correspondence with or equal to the image feature value of the display image in each frame in the (N+1)th movement cycle, determining the display image displayed in the image display region as a non-static image.

6. The method for processing the display image according to claim 3, wherein the movement cycle is time taken for the movable region to move from the first position and then back to the first position.

7. The method for processing the display image according to claim 1, wherein the image display region is a portion, which is not removed from a display screen during image rotation, of the movable region.

8. The method for processing the display image according to claim 1, further comprising:

reducing display brightness of the image display region in a case where the display image is determined as the static image.

9. A display image processing device, comprising:

a processor; and a memory, wherein the memory is stored with instructions which are executed by the processor to implement the method according to claim 1, for processing the display image.

10. A display device, comprising the display image processing device according to claim 9.

11. A storage medium, for storing non-volatile computer readable instructions, wherein the non-volatile computer readable instructions are executed by a computer to implement the method according to claim 1, for processing the display image.

* * * * *